United States Patent [19]

Kaneko et al.

[11] Patent Number: 4,797,648

[45] Date of Patent: Jan. 10, 1989

[54] CHIP INDUCTOR

[75] Inventors: Toshimi Kaneko; Ryuichi Fujinaga; Tetsuya Morinaga; Atsuo Senda; Toshi Numata; Hideyuki Kashio, all of Kyoto, Japan

[73] Assignee: Murata Manufacturing Co., Ltd., Japan

[21] Appl. No.: 165,763

[22] Filed: Mar. 9, 1988

[30] Foreign Application Priority Data

Mar. 9, 1987 [JP] Japan ..... 62-53657

[51] Int. Cl.[4] ..... H01F 15/10

[52] U.S. Cl. ..... 336/192; 228/124; 336/65; 336/233

[58] Field of Search ..... 361/405; 228/123, 124, 228/208, 209, 254, 263.21, 263.13; 336/192, 65, 221

[56] References Cited

U.S. PATENT DOCUMENTS 3,413,711 12/1968 Brewer et al. ..... 228/124

3,812,442 5/1974 Mackelroy ..... 336/192 X

*Primary Examiner*—Thomas J. Kozma

*Attorney, Agent, or Firm*—Ostrolenk, Faber, Gerb & Soffen

[57] ABSTRACT

A chip inductor having a pair of terminal electrodes formed on the surface of a magnetic core which holds a winding therearound. The terminal electrodes have films which are made from a nickel alloy having a relatively high resistivity and a relatively low magnetic permeability. Such nickel alloys includes, for example, nickel-chromium alloy, nickel-phosphorus alloy and nickel-copper alloy.

7 Claims, 1 Drawing Sheet

CHIP INDUCTOR

BACKGROUND OF THE INVENTION

1. Field of the Invention

This invention relates to a chip inductor of the type having terminal electrodes formed on the surface of a magnetic core.

2. Description of the Prior Art

FIG. 5 is a perspective view showing an example of a conventional chip inductor. It comprises a magnetic core 2 made from ferrite or the like having a winding support portion 2*a* and flange portions 2*b* and 2*c* formed on the upper and lower sides of said winding support portion 2*a*, a winding 4 mounted on said winding support portion 2*a*, a pair of terminal electrodes 6*a* and 6*b* for installing said inductor on a printed circuit board or the like, the opposite ends of said winding 4 being electrically connected to the terminal electrodes 6*a* and 6*b* as by soldering (not shown).

Silver-palladium (Ag-Pd) has heretofore been used for said terminal electrodes 6*a* and 6*b* to provide protection against the electrode material being leached by soldering. Although such solder leaching can be minimized by increasing the palladium content, adhesion to solder decreases. Further, since palladium is expensive, there has been a need for some other metal which is less expensive.

As an approach thereto, the use of nickel, which is most effective for prevention of solder leaching and which is inexpensive, for the terminal electrodes 6*a* and 6*b*, would be contemplated; however, since nickel has a relatively low resistance and a relatively high magnetic permeability, the use of nickel for said terminal electrodes 6*a* and 6*b* would offer a problem that the Q factor of the inductor is deteriorated to a large extent by eddy current loss produced therein.

More specifically, the magnetic flux produced in the winding 4 also necessarily passes through the terminal electrodes 6*a* and 6*b*, whereupon an eddy current flows in the terminal electrodes 6*a* and 6*b*. This eddy current i is generally expressed by rot $i=-k$ (dB/dt), where k is conductivity, which is the reciprocal of resistivity, and B is magnetic flux density. In this case, the higher the magnetic permeability of the terminal electrodes 6*a* and 6*b*, the greater the amount of magnetic flux passing therethrough and hence the greater the magnetic flux density B. Further, the smaller the resistivity, the greater the conductivity k and hence the eddy current i increases, producing energy loss which, in turn, results in a high deterioration in the Q factor.

SUMMARY OF THE INVENTION

Accordingly, an object of the invention is to provide a chip inductor having terminal electrodes made from a material which is capable of preventing deterioration of the Q factor of the inductor while utilizing the soldering corrosion resistance of nickel.

A chip inductor according to this invention is characterized in that the terminal electrodes have films made from a nickel alloy whose magnetic permeability is low, such a nickel chromium alloy, nickel phosphorus alloy, or nickel copper alloy.

Since nickel alloys, such as nickel chromium alloy, nickel phosphorus alloy and nickel copper alloy, are nickel series materials, they are less prone to solder leaching. Furthermore, since they are higher in resistivity and extremely lower in magnetic permeability than nickel itself, eddy current loss in the terminal electrodes is minimized, with the result that deterioration of the Q factor is prevented.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
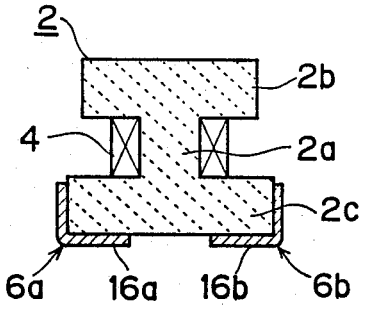
FIG. 1 is a vertical sectional view showing a chip inductor according to an embodiment of the invention.
Figure 5:
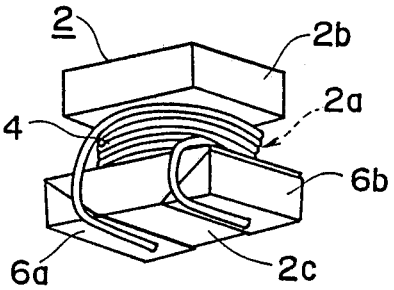
FIG. 5 PRIOR ART
FIG. 5 is a perspective view showing an example of a conventional chip inductor.

FIG. 1 is a vertical sectional view showing a chip inductor according to an embodiment of the invention. Parts equivalent to the elements shown in FIG. 5 are designated by like reference characters, and the following description will be directed mainly to differences from the prior art.

In this embodiment, instead of the terminal electrodes 6*a* and 6*b* made from silver-palladium described above, terminal electrodes 6*a* and 6*b* formed of films 16*a* and 16*b* of nickel alloy, such as nickel chromium (Ni-Cr) alloy, nickel phosphorus (Ni-P) alloy or nickel copper (Ni-Cu) alloy are formed on the surface of the flange portion 2*c* of a magnetic core 2 as by electroless plating or sputtering. The nickel alloy may contain 5 to 44% chromium, 1 to 15% phosphorus, or 15 to 90% copper.

Since nickel alloys, such as nickel chromium alloy, nickel phosphorus alloy and nickel copper alloy, are nickel series materials, they are less prone to solder leaching. Furthermore, since they are higher in resistivity and extremely lower in magnetic permeability than nickel itself, eddy current loss in the terminal electrodes 6*a* and 6*b* is minimized, with the result that deterioration of the Q factor of the chip inductor is prevented. Whereas conventional silver-palladium electrodes are generally formed by baking a paste, alloy film such as 16*a* and 16*b* described above can be formed by plating or the like; therefore, the reduction of the thickness of the terminal electrodes 6*a* and 6*b* can be realized, whereby the eddy current can be further reduced to minimize deterioration of the Q factor of the inductor.

Figure 2:
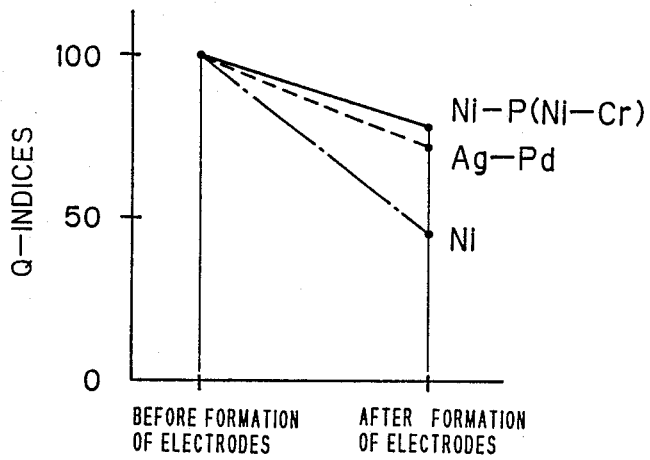
FIG. 2 is a graph showing by way of example how deterioration of the Q factor of an inductor differs according to different materials for the terminal electrodes.

How deterioration of the Q factor of an inductor differs according to different materials for the terminal electrodes is shown by way of example in FIG. 2. This graph expresses the Q factor of an inductor with the value of the Q factor prior to the formation of terminal electrodes taken as 100. The film thickness of the terminal electrodes was 10 μm or above in the case of Ag-Pd because of the employment of a method in which a paste is baked, and it was 2 μm in other cases because of the employment of a method based on plating. As indicated by the graph, deterioration of the Q factor subsequent to the formation of terminal electrodes is much less in the case where Ni-P, Ni-Cr or Ni-Cu is used as in the embodiment of the invention than in the case where Ni is used; furthermore, it is seen that in the case of the invention the deterioration is still less than in the case of using the conventional Ag-Pd.

In this connection, it is to be noted that the invention is not precluded from constructing the terminal electrodes 6a and 6b in multi-layer form by making films from other metals in addition to the nickel alloy films 16a and 16b, unless the preventive effect of the nickel alloy films 16a and 16b for a deterioration in the Q factor is considerably reduced.

Figure 3:
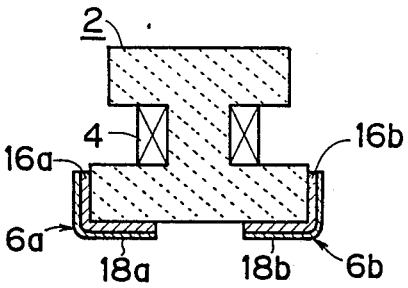
FIGS. 3 and 4 are vertical sectional views showing chip inductors according to other embodiments of the invention.
Figure 4:
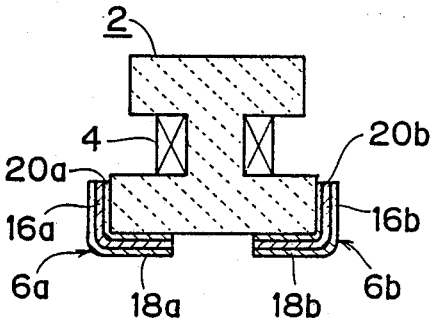

For example, in the terminal electrodes 6a and 6b shown in FIG. 3, the surface of the nickel alloy films 16a and 16b are formed with films 18a and 18b of a metal which is superior in solderability, such as tin or solder, as by electroplating, whereby solderability quality is further improved. In the embodiment shown in FIG. 4, layers 20a and 20b of a metal which is superior in adhesion to the magnetic core 2 of ferrite, such as titanium, are formed between the nickel alloy films 16a, 16b and the magnetic core 2 as by spattering, whereby the peel resistance of the terminal electrodes 6a and 6b is further improved.

In addition, the terminal electrodes as described above are effective in all cases where they are to be formed on the surface of a magnetic core, the configuration of the magnetic core being optional, not limited to the one illustrated in the figures. Thus, substantially the same merits will be also obtained when the invention is applied to a pot type core or the like.

Further, in the embodiment shown in FIG. 1 the nickel alloy films 16a and 16b have been described as being formed as by electroless plating. In this case, the nickel alloy films 16a and 16b have to be formed only on particular regions of the surface of the magnetic core 2; therefore, in performing electroless plating, some measure must be taken, such as a resist film formed on the region where the formation of nickel alloy films is not desired. However, the formation of nickel alloy films may be performed by printing a silver paste on the region where they are to be formed, forming silver films in advance by baking the same, and electrodepositing a nickel alloy on the silver film by electroplating.

Although the present invention has been described and illustrated in detail, it is clearly understood that the same is by way of illustration and example only and is not to be taken by way of limitation, the scope of the present invention being limited only by the terms of the appended claims.

What is claimed is:

1. A chip inductor comprising:

a magnetic core having a surface;

winding means disposed in relation to said magnetic core;

terminal electrode means electrically connected to said winding means and formed on said surface of said magnetic core; and said terminal electrode means including a film made from a nickel alloy.

2. A chip inductor as set forth in claim 1, said nickel alloy contains a metal having a higher resistivity and a lower magnetic permeability than nickel.

3. A chip inductor as set forth in claim 1, wherein said nickel alloy is at least one of nickel-chromium alloy, nickel-phosphorus alloy and nickel-copper alloy.

4. A chip inductor as set forth in claim 1, wherein said terminal electrode has a film formed on the outer surface of said nickel alloy film, the first-mentioned film being made from a metal which is superior in solderability.

5. A chip inductor as set forth in claim 1, wherein said teminal electrode has a basis film formed between said surface of said magnetic core and said nickel alloy film.

6. A chip inductor as set forth in claim 5, wherein said basis film is made from a metal which is superior in adhesion to said surface of said magnetic core.

7. A chip inductor as set forth in claim 5, wherein said basis film is made from an electrically conductive material.

* * * * *